US011006686B2

(12) United States Patent
Baschak et al.

(10) Patent No.: US 11,006,686 B2
(45) Date of Patent: May 18, 2021

(54) GRIP-ENHANCING FILM FOR CUFF EDGES

(71) Applicant: NIKE, Inc., Beaverton, OR (US)

(72) Inventors: Kimberly D. Baschak, Portland, OR (US); Kyle Schepke, Portland, OR (US)

(73) Assignee: NIKE, INC., Beaverton, OR (US)

( * ) Notice: Subject to any disclaimer, the term of this patent is extended or adjusted under 35 U.S.C. 154(b) by 186 days.

(21) Appl. No.: 16/351,239

(22) Filed: Mar. 12, 2019

(65) Prior Publication Data

US 2019/0364999 A1 Dec. 5, 2019

Related U.S. Application Data

(60) Provisional application No. 62/678,367, filed on May 31, 2018.

(51) Int. Cl.
*A41D 27/08* (2006.01)
*A41D 27/10* (2006.01)
(Continued)

(52) U.S. Cl.
CPC ..... *A41D 27/08* (2013.01); *A41D 1/06* (2013.01); *A41D 1/089* (2018.01); *A41D 27/10* (2013.01);
(Continued)

(58) Field of Classification Search
CPC ..... A41D 27/08; A41D 27/10; A41D 1/06; A41D 1/089; A41D 2600/10; A41D 2400/82; A41D 2500/50; A41D 2500/52; A41B 2400/82; A41B 2500/50; A41B 11/128; A41B 11/126; A41F 17/00; A41F 9/00; Y10T 428/24; Y10T 428/24777
See application file for complete search history.

(56) References Cited

U.S. PATENT DOCUMENTS 2,514,108 A 7/1950 Vogt
3,930,090 A 12/1975 Campbell, Sr. et al.
(Continued)

FOREIGN PATENT DOCUMENTS

DE 202010016255 U1 3/2011
EP 1051923 A2 11/2000
WO 2015010010 A1 1/2015

OTHER PUBLICATIONS

"Mid Body Plastic Surgery Compression Garment—Mid Thigh—Stage 2 (Design Veronique)," make {me} heal, makemeheal.com, MMH ID: 10215; Brand: Design Veronique; Model No. 1650, accessed: Dec. 2017. http://www.makemeheal.com/mmh/product.do?id=10215&procid=1&catid=1.
(Continued)

*Primary Examiner* — David Sample
*Assistant Examiner* — Donald M Flores, Jr.
(74) *Attorney, Agent, or Firm* — Shook, Hardy & Bacon L.L.P.

(57) ABSTRACT

Aspects herein are directed to a grip film or grip film kit comprising an edge trim portion and at least one ovoid portion. The edge trim portion may have a wave-shaped configuration in which the ovoid portion is at least partially disposed. Other aspects herein are directed to an extremity covering portion comprising the grip film on at least one opening to provide grip that may assist in maintaining the position and/or configuration of the extremity covering portion on the body of a wearer.

20 Claims, 6 Drawing Sheets

(51) Int. Cl.

| | |
|---|---|
| ***A41D 1/06*** | (2006.01) |
| ***A41D 1/089*** | (2018.01) |
| ***A41B 1/08*** | (2006.01) |
| ***A41F 17/00*** | (2006.01) |

(52) U.S. Cl.

CPC ..... *A41F 17/00* (2013.01); *A41B 2400/82* (2013.01); *A41B 2500/50* (2013.01); *A41D 2400/82* (2013.01); *A41D 2500/50* (2013.01); *A41D 2600/10* (2013.01); *Y10T 428/24* (2015.01); *Y10T 428/24777* (2015.01)

(56) References Cited

U.S. PATENT DOCUMENTS

| | | | |
|---|---|---|---|
| 5,426,791 | A | 6/1995 | Sydor et al. |
| 6,797,352 | B2 | 9/2004 | Fowler |
| 8,087,094 | B2 | 1/2012 | Karasina |
| 8,146,172 | B2 | 4/2012 | Geiwald |
| 8,172,782 | B2 | 5/2012 | Rock |
| 8,407,814 | B2 | 4/2013 | Caillibotte et al. |
| 8,683,715 | B1 | 4/2014 | Cantrell et al. |
| 8,990,965 | B2 | 3/2015 | Waldman et al. |
| 9,232,822 | B1 | 1/2016 | Khubani |
| 2005/0271847 | A1 | 12/2005 | Antonini |
| 2006/0021390 | A1 | 2/2006 | Gebel et al. |
| 2010/0184355 | A1 | 7/2010 | Kennedy |
| 2011/0041232 | A1 | 2/2011 | Covelli et al. |
| 2012/0036616 | A1 | 2/2012 | Miyasaka |
| 2013/0189900 | A1 | 7/2013 | Bloch Marco |
| 2014/0230132 | A1 | 8/2014 | Bakker et al. |
| 2015/0290049 | A1 | 10/2015 | Riha-Scott et al. |
| 2016/0038346 | A1 | 2/2016 | Collins et al. |
| 2017/0002234 | A1 | 1/2017 | Martin et al. |
| 2017/0013888 | A1* | 1/2017 | Webb ..... A41F 5/00 |

OTHER PUBLICATIONS

"Ground Hog™ Electro-Static Spray Painting Gloves," Superior Glove®, superiorglove.com, #1401DGH, accessed: Dec. 2017. http://www.superiorglove.com/system/catalog_pdfs/4740/original/1401DGH-SS.pdf.

International Search Report and Written Opinion dated Jun. 27, 2019 in International Patent Application No. PCT/US2019/024369, 16 pages.

International Preliminary Report on Patentability received for PCT Patent Application No. PCT/US2019/024369, dated Dec. 10, 2020, 9 pages.

* cited by examiner

GRIP-ENHANCING FILM FOR CUFF EDGES

CROSS-REFERENCE TO RELATED APPLICATIONS

This application, U.S. appication Ser. No. 16/351,239, filed Mar. 12, 2019 claims priority to U.S. Provisional Patent Application No. 62/678,367, filed May 31, 2018, and entitled, "Grip-Enhancing Film for Cuff Edges," the entirety of which is incorporated here by reference.

TECHNICAL FIELD

Aspects herein relate to a film configured for cuff edges featuring an edge trim portion and ovoid portions providing grip-enhancing properties.

BACKGROUND

Many conventional edge grip solutions for garments may suffer from a variety of challenges that may be undesirable to a wearer. For example, the edge may lose its grip when it becomes wet, whether by perspiration or weather conditions. Some gripping features may create excessive compression, causing discomfort or restricting blood flow; yet others have a tendency to roll up, resulting in yet greater and undesirable compression and affecting, for example, aerodynamic characteristics of the garment.

DESCRIPTION OF THE DRAWINGS

Examples of aspects herein are described in detail below with reference to the attached drawing figures, wherein.

DETAILED DESCRIPTION

Figure 1:
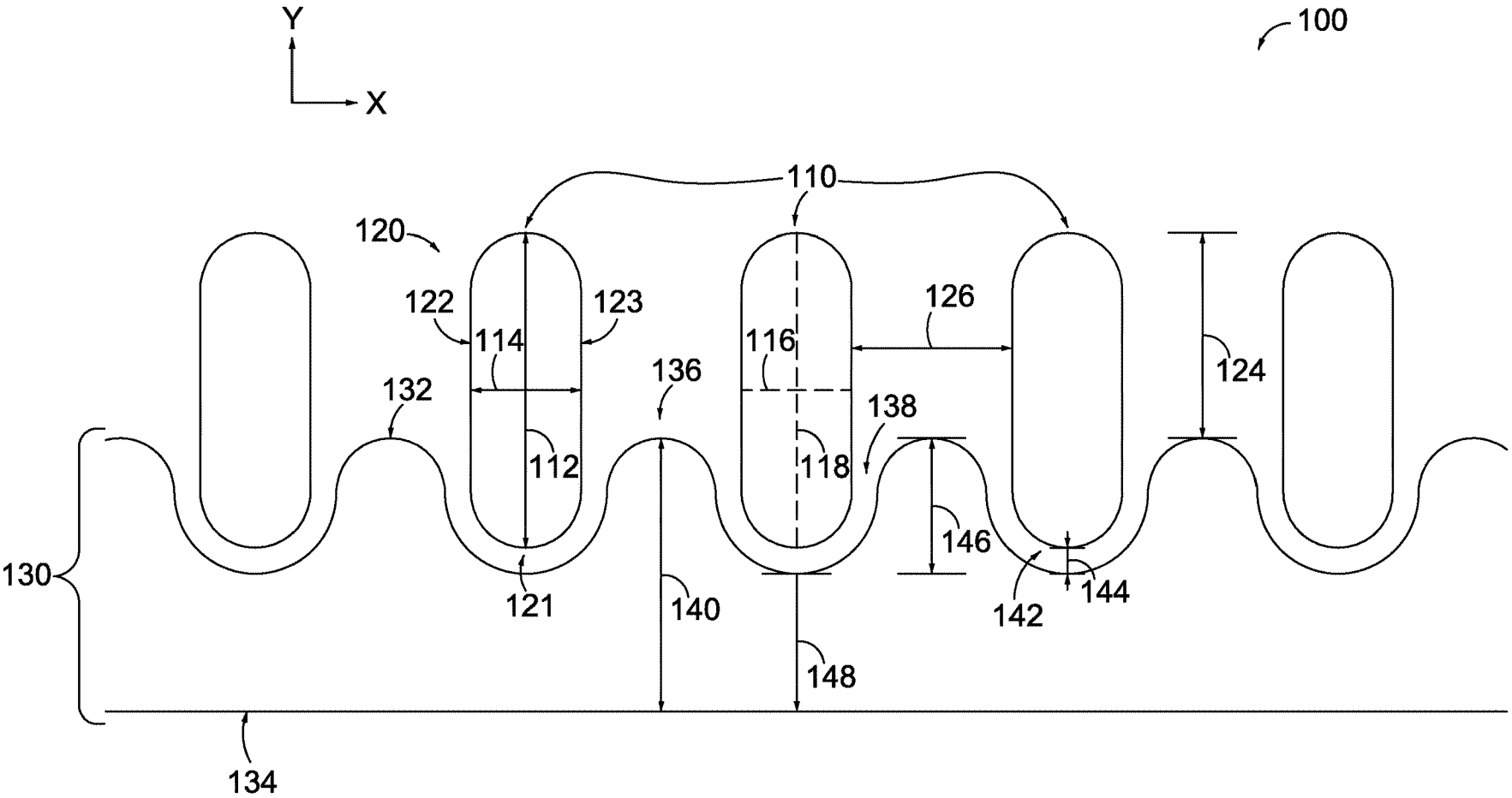
FIG. 1 illustrates a plan view of a grip film having an edge trim portion and a plurality of ovoid portions in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

By way of background, it may be desirable in some articles, such as athletic garments or accessories, to maintain the position and/or configuration of an opening (e.g., a distal arm sleeve opening, a distal short leg opening, a distal pant leg opening, a compression sleeve opening, and the like). For example, a basketball player wearing a compression sleeve generally desires the sleeve to remain in its as-donned position throughout the duration of a basketball game; a track and field athlete wearing a unitard generally desires the leg openings to remain in the athlete's preferred position. Conventionally, this may have been done through the use of compression bands or by simply relying on the compression properties of the article itself. These conventional means may have too little grip to remain in the as-donned or preferred position. They may lose their grip when the article is exposed to moisture, whether atmospheric, activity-based (such as by use in a pool), or due to perspiration of the wearer. They may have a tendency to roll which may affect the aerodynamic properties of the article. And they may cause excessive and undesirable compression. In order to provide enhanced grip to an article, aspects herein contemplate a grip film having distinct and separate portions that are comfortable to a wearer yet provide grip, permit stretch, and reduce the likelihood of rolling.

At a high level, aspects herein relate to a grip film, an extremity covering portion of a garment having a grip film applied thereto, and a grip film kit. In aspects, the grip film may be formed of an elastomeric material, such as polyurethane, that has stretch and recovery properties. Further, the elastomeric material may have a first coefficient of friction when dry and a second coefficient of friction when wet, where the second coefficient of friction is greater than the first coefficient of friction. In other words, the grip film may increase in grip when wet. It is contemplated herein that the grip film may comprise flocking to improve wearer comfort.

Continuing, the grip film comprises a continuous edge trim portion and a plurality of ovoid portions that are separate and distinct from each other and from the edge trim portion. The edge trim portion has a first edge, which may be linear and be configured to be congruent or aligned with an opening edge of an article, and a second edge opposite the first edge. The second edge may comprise a wave-shaped configuration that defines at least one peak and at least one trough. Each ovoid portion has a first end and a second end; the first end of each ovoid portion is at least partially disposed within a trough of the second edge of the edge trim portion.

The use of the separate ovoid portions in combination with the wave-shaped configuration of the second edge of the edge trim portion helps to create a smoother compression transition when moving toward an opening edge of an article. This is opposed to more traditional films with a band-like configuration (e.g. two linear and parallel sides) that have a distinct and abrupt transition from no compression to compression. Because there is not a gradual transition with these more traditional compression band-like films, the configuration may prove to be uncomfortable to the wearer producing, for instance, a tourniquet-like effect. With respect to the grip film described herein and in one example aspect, the ovoid portions may be positioned on the article to correspond to areas of the human body having a greater circumference (e.g., a mid- to upper-thigh region), and the edge trim portion may be positioned on the article to corresponds to areas of the human body having a smaller circumference (e.g., a lower thigh or knee area). With this configuration, because the ovoid portions are separate from one another, the ovoid portions spread apart from one another when the article is donned to accommodate the greater circumference of the respective body portion and to provide a smoother compression transition to the continuous edge trim portion positioned in the smaller circumference area. As well, use of the wave-shaped configuration of the edge trim portion also helps to provide a smoother compression transition as opposed to, for instance, a linear edge. In combination, the ovoid portions and the edge trim portion provide a greater grip film surface area as compared to more traditional band-like constructions. The smoother compression transition, in example aspects, may reduce the likelihood that an edge to which the grip film is applied will roll. Moreover, the rounded ends of the ovoid portions reduce the likelihood of delamination from an article and discomfort to the wearer.

When the grip film is incorporated into an extremity covering portion of an article or garment, the grip film may be positioned so as to be on an inner-facing surface of the extremity covering portion. The extremity covering portion may be a stand-alone article, such as a compression sleeve or calf sleeve or may be a portion of a garment. In the case of a stand-alone article, the extremity covering portion may comprise, for instance, two openings (e.g., a distal opening and a proximal opening) through which an extremity is designed to pass. At least one of the openings may comprise the grip film on an inner-facing surface to keep the opening in the as-donned or preferred location and/or configuration on the wearer. When the extremity covering portion is part of a garment, the extremity covering portion may comprise a sleeve (long sleeve or short sleeve) or a pant or short leg portion and may comprise the grip film on an inner-facing surface of the distal end of the extremity covering portion. By positioning the grip film as described, an edge that may be prone to slippage, rolling, or other undesirable edge movement may be more likely to stay in position, even when the grip film is exposed to moisture. Moreover, because of the shape configuration of the grip film, the extremity covering portion avoids creating excessive compression or discomfort at the edge of the opening.

Accordingly, aspects herein are directed to a grip film having an edge trim portion and at least one ovoid portion. The edge trim portion has a first edge and a second edge, the second edge having a wave-shaped configuration that forms at least one peak and at least one trough. The at least one ovoid portion has a first end and a second end opposite the first end along a major axis of the at least one ovoid portion. The first end of the at least one ovoid portion is at least partially disposed in the at least one trough.

Aspects herein are further directed to an extremity covering portion of a garment having an edge trim portion and a plurality of ovoid portions. The edge trim extends continuously and circumferentially around an edge of a first opening of the extremity covering portion. The edge trim portion has a first edge and a second edge opposite the first edge, the first edge aligned with the edge of the first opening of the extremity covering portion and the second edge having a plurality of peaks and a plurality of troughs. Each of the plurality of ovoid portions has a first end and a second end opposite the first end along a major axis of the ovoid portion, and the first end of each of the ovoid portions is at least partially disposed within a trough of the plurality of troughs of the edge trim portion.

Aspects herein are additionally directed to a kit for applying a grip film. The kit comprises a carrier sheet, an edge trim portion, and at least one ovoid portion. The edge trim portion has a first edge and a second edge opposite the first edge. The second edge has a wave-shaped configuration having at least one peak and at least one trough. The at least one ovoid portion has a first end and a second end opposite the first end along a major axis of the at least one ovoid portion, the first end of the at least one ovoid portion is at least partially disposed within the at least one trough. Each of the edge trim portion and the ovoid portion are overlaid and temporarily adhered to the carrier sheet.

Positional terms as used herein to describe a garment or an extremity covering portion such as "anterior," "posterior," "front," "back," "upper," "lower," "inner-facing surface," "outer-facing surface," and the like are with respect to the garment and/or the extremity covering portion being appropriately sized and being worn as intended by a wearer standing in an upright position. The term "continuous" as used herein is meant to encompass a grip film or an edge trim portion of the grip film that extends without interruption (e.g., gaps). However, with respect to the edge trim portion of the grip film, it is contemplated herein that when the edge trim portion is applied to an extremity covering portion of a garment, there may be a seam line or small gap where the respective ends of the edge trim portion meet.

Continuing, the term "wave-shaped configuration" as used herein means any one or more configurations resembling a wave. Examples of wave-shaped configurations include, but are not limited to, a sine wave, a wave resembling consecutive parabolas (alternating between the focus being above or below the vertex on a y-axis), and a wave resembling consecutive semicircles (alternating between opening upward or downward). The terms "peak" and "trough" are used in their conventional sense of identifying portions of a wave, and relate to the highest and lowest point of the wave, respectively, relative to a y-axis. The term "about" as used herein means within ±5% of a given value.

Tuning now to FIG. 1, a plan view of a portion of a grip film 100 having an edge trim portion 130 having a wave-shaped configuration and a plurality of ovoid portions 110 is shown in accordance with aspects herein. In an example aspect, the grip film 100 may comprise an elastomeric film having stretch and recovery properties. The elastomeric film may comprise polyurethane in one aspect. The grip film 100 in this aspect may comprise a first coefficient of friction when dry and a second coefficient of friction when wet where the second coefficient of frictions is greater than the first coefficient of friction.

Each ovoid portion 110 may be at least partially disposed in a trough 138 formed by the edge trim portion 130 having the wave-shaped configuration. As seen in FIG. 1, the wave-shaped configuration may take the form of mirrored alternating semicircles. That is, the wave may alternate between a first semicircle and a second semicircle, wherein the first semicircle opens downward and the second semicircle opens upward. It is contemplated herein that the radius of curvature of the first semicircle and the second semicircle may be the same or different in example aspects. In other words, it is contemplated herein that the radius of curvature of the peaks and troughs of the edge trim portion 130 may have the same or a different radius of curvature. Any and all aspects, and any variation thereof, are contemplated as being within aspects herein.

The edge trim portion 130 comprises a first edge 134 and a second edge 132 opposite the first edge. As shown in FIG. 1, the first edge 134 may be substantially linear, that is linear +/−5%. In other aspects, the first edge 134 may be curved. The second edge 132 may be wave-shaped, and accordingly comprise at least one peak 136 and at least one trough 138. In aspects, the second edge 132 comprises a wave form having a repeating period, each repeating period comprising, for instance, a single peak 136 and a single trough 138.

In aspects, the edge trim portion 130 comprises a peak height 140 as measured between the first edge 134 and the second edge 132 of the peak 136 (i.e., measured at its highest point). In aspects, the peak height 140 may be about 12.5 mm, in other aspects it may be in the range of from about 5 mm to about 25 mm. As used herein, the term "about" means within ±5% of a designated value. The edge trim portion 130 further comprises a trough height 148 as measured between the first edge 134 and the second edge 132 of the trough 138 (i.e., measured at its lowest point). In aspects, the trough height 148 may be about 7.25 mm, in other aspects it may be in the range of from about 2.5 mm to about 20 mm. The edge trim portion 130 additionally comprises an amplitude 146, equating to the difference between the peak height 140 and the trough height 148. In aspects, the amplitude 146 may be about 5.25 mm, in other aspects, the amplitude 146 may be in the range of from about 2.5 mm to about 22.5 mm.

The grip film 100 also comprises the plurality of ovoid portions 110. In aspects where the grip film 100 comprises more than one ovoid portion 110, any one or more ovoid portions 110 may be sized, shaped, or otherwise configured the same as or differently than any one or more of the other ovoid portions 110. Each ovoid portion 110 comprises a first end 121 and a second end 120 opposite the first end 121. The ovoid portion 110 may be sized, shaped, or otherwise configured such that the first end 121 may at least be partially disposed within the trough 138 formed by the wave-shaped configuration of the second edge 132 of the edge trim portion 130. As seen in FIG. 1, the first end 121 and the second end 120 may resemble a semicircle; however, at least one of the first end 121 and the second end 120 may take the form of any number of geometric shapes or may be curved in a non-circular manner. For instance, the first end 121 and/or the second end 120 may take on more complex curved shapes having one or more portions with different radii of curvature. In aspects, the first end 121 is separated from (or spaced-apart from) the second edge 132 of the edge trim portion 130 by a gap 142. The gap 142 may have a width 144 of about 1.25 mm or may be in the range of from about 0.5 mm to about 5 mm. To describe this differently, it is contemplated herein that the ovoid portions 110 comprise a separate and distinct construction from the edge trim portion 130 such that the ovoid portions 110 may be independently movable from the edge trim portion 130.

In some example aspects, each ovoid portion 110 may be pill-shaped, generally resembling a rectangle with a semicircular first end 121 and a semicircular second end 120. In such an aspect, each ovoid portion 110 may have a first side 122 and a second side 123, each of which may be linear and parallel to one another, both optionally being perpendicular to the first edge 134 of the edge trim portion 130. In other aspects, each ovoid portion 110 may have any shape resembling an ovoid, including an ellipse. The grip film 100 may have more than one ovoid portion 110; in such a case, and as shown in FIG. 1, an inter-ovoid distance 126 separates the second side 123 of a first ovoid portion 110 and the first side 122 of a second ovoid portion 110. The inter-ovoid distance 126 may be about 7.0 mm, or may be in the range of from about 1.5 mm to about 30 mm.

Each ovoid portion 110 may have a major axis 118, parallel to the y-axis in FIG. 1, and a minor axis 116, parallel to the x-axis in FIG. 1. Each ovoid portion 110 may have a length 112 as measured along the major axis 118. The length 112 may be about 13.25 mm, or may be in the range of from about 5 mm to about 50 mm. Each ovoid portion 110 may also have a width 114 as measured along the minor axis 116. The width 114 may be about 4.6 mm, or may be in the range of from about 2 mm to about 15 mm. A distance 124 can be measured from the second edge 132 of the highest point of the peak 136 to a point created by the intersection of the major axis 118 with the second end 120 of the ovoid portion 110. The distance 124, parallel to the major axis 118, may be about 8.9 mm or about 9.25 mm, or may be in the range of from about 2 mm to about 45 mm.

Figure 2:
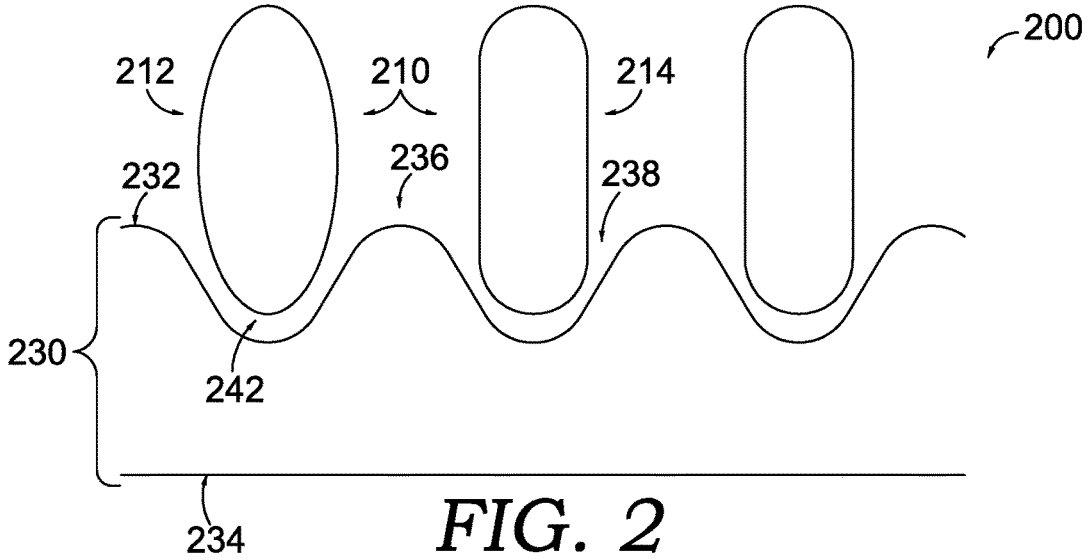
FIG. 2 illustrates a plan view of a grip film having an edge trim portion comprising a sinusoidal wave configuration and a plurality of ovoid portions in accordance with aspects herein.

Turning now to FIG. 2, a plan view of a grip film 200 is illustrated in accordance with aspects herein. The grip film 200 may have any one or more features described above in reference to the grip film 100. The grip film 200 may have an edge trim portion 230 and at least one ovoid portion 210. The edge trim portion 230 may have a first edge 234 and a second edge 232 opposite the first edge. The second edge 232 has a wave-shaped configuration, forming at least one trough 238 and at least one peak 236. The wave-shaped configuration of the second edge 232 may take the form of a sine-like wave and the first edge 234 may be substantially linear. The ovoid portion 210 may take the form of an ellipse 212 and/or a pill-shaped finger 214. Regardless of the shape, size, or configuration, at least one end of the ovoid portion 210 may be at least partially disposed in the trough 238 of the edge trim portion 230 but be offset from (or spaced-apart from) the trough 238 by a gap 242.

Figure 3:
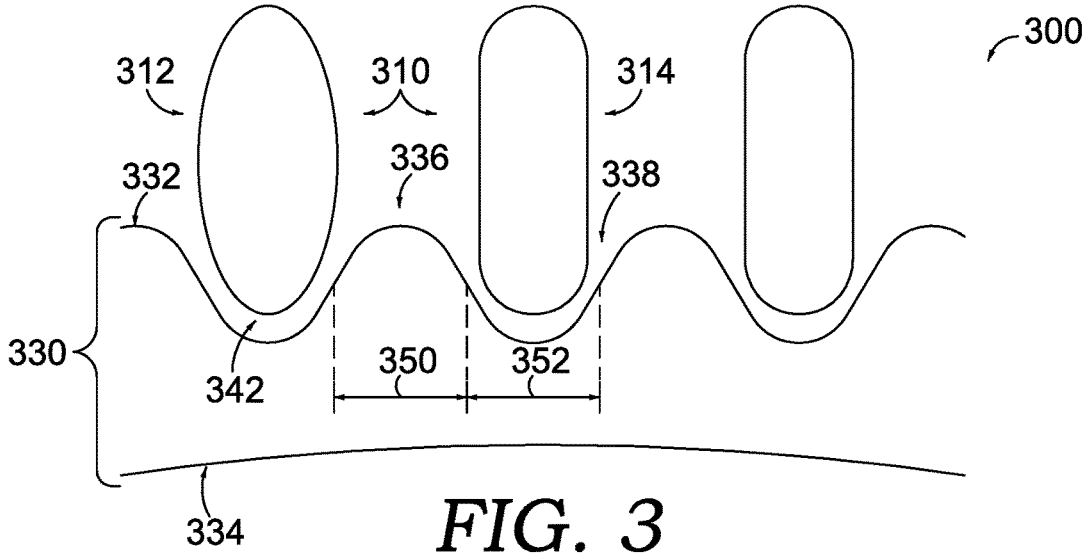
FIG. 3 illustrates a plan view of a grip film having an edge trim portion with a curved edge and a plurality of ovoid portions in accordance with aspects herein.

Continuing, FIG. 3 illustrates a plan view of a grip film 300 in accordance with aspects herein. The grip film 300 may have any one or more features described above in reference to the grip film 100 and/or the grip film 200. The grip film 300 comprises an edge trim portion 330 and at least one ovoid portion 310. The edge trim portion 330 may have a first edge 334 and a second edge 332 opposite the first edge 334. The second edge 332 has a wave-shaped configuration, forming at least one trough 338 and at least one peak 336. The wave-shaped configuration of the second edge 332 may take the form of a sine-like wave. The wave-shaped configuration of the second edge 332 may be said to have a peak width 350 of each peak 336 as measured between consecutive points where the wave-shaped second edge 332 crosses an axis in the x plane that bisects the wave-shaped second edge 332. The wave-shaped configuration of the second edge 332 may also be said to have a trough width 352 of each trough 338 as measured between consecutive points where the wave-shaped second edge 332 crosses the axis in the x plane that bisects the wave-shaped second edge 332. Each of the peak width 350 and the trough width 352 may be about 7 mm, or may be in the range of from about 4 mm to about 20 mm. In aspects, and as shown in FIG. 3, the peak width 350 may be substantially equal to the trough width 352.

In an example aspect, the first edge 334 may be configured to be curved. The curvature of the first edge 334 may be, for example, configured to conform to the curvature of an opening of an extremity covering portion or a garment to which the grip film may be applied. The ovoid portion 310 may take the form of an ellipse 312 or a pill-shaped finger 314. Regardless of the shape, size, or configuration of the ovoid portion 310, at least one end of the ovoid portion 310 may be at least partially disposed in the trough 338 but offset from (or spaced-apart from) the second edge 332 of the trough 338 by a gap 342.

Figure 4:
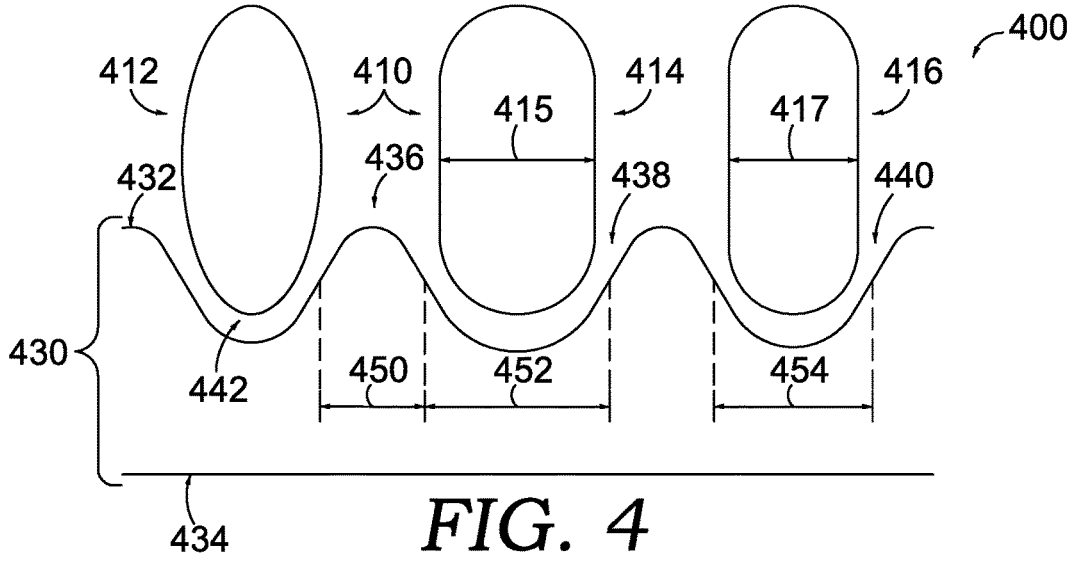
FIG. 4 illustrates a plan view of a grip film having an edge trim portion with troughs and peaks having unequal widths and a plurality of ovoid portions of various shapes in accordance with aspects herein.

Turning now to FIG. 4, a plan view of a grip film 400 is illustrated in accordance with aspects herein. The grip film 400 may have any one or more features described above in reference to the grip film 100, the grip film 200, and/or the grip film 300. The grip film 400 may comprise an edge trim portion 430 and at least one ovoid portion 410. The edge trim portion 430 may have a first edge 434 and a second edge 432 opposite the first edge 434. The first edge 434 may be linear, as seen in FIG. 4. The second edge 432 has a wave-shaped configuration, forming at least one peak 436, at least a first trough 438, and at least a second trough 440. The wave-shaped configuration of the second edge 432 may result in the at least one peak 436 having a peak width 450 (as measured similar to peak width 350), the first trough 438 having a first trough width 452 (as measured similar to trough width 352), and the second trough 440 having a second trough width 454. In aspects, the peak width 450 may be different than the first trough width 452 and the second trough width 454. In other aspects, the peak width 450 may be the same as one of the first trough width 452 and the second trough width 454. As seen in FIG. 4, the first trough width 452 may be unequal to the second trough width 454; alternatively, they may be equal.

The ovoid portion 410 may take the form of an ellipse 412 or a pill-shaped finger 414, 416. Regardless of the shape, size, or configuration of the ovoid portion 410, at least one end of the ovoid portion 410 may be at least partially disposed in a trough 438. In configurations where the first trough width 452 is unequal to the second trough width 454, the first pill-shaped finger 414 may be at least partially disposed in the first trough 438 and have a first width 415, and the second pill-shaped finger 416 may be at least partially disposed in the second trough 440 and have a second width 417, the second width 417 being less than the first width 415. To describe this in a different way, it is contemplated herein that the widths of the ovoid portions 410 may be such that the ovoid portions 410 substantially fill the respective trough in which they are disposed. This may help to maximize the surface area of the grip film 400.

In the aspects shown in FIGS. 2-4, the ovoid portions are shown as comprising two or more different shapes (e.g., pill-shaped and ellipse). It is contemplated herein that the ovoid portions may all comprise the same shape such as the ellipse shape or the pill-shaped finger shape. Any and all aspects, and any variation thereof, are contemplated as being within aspects herein.

Figure 5:
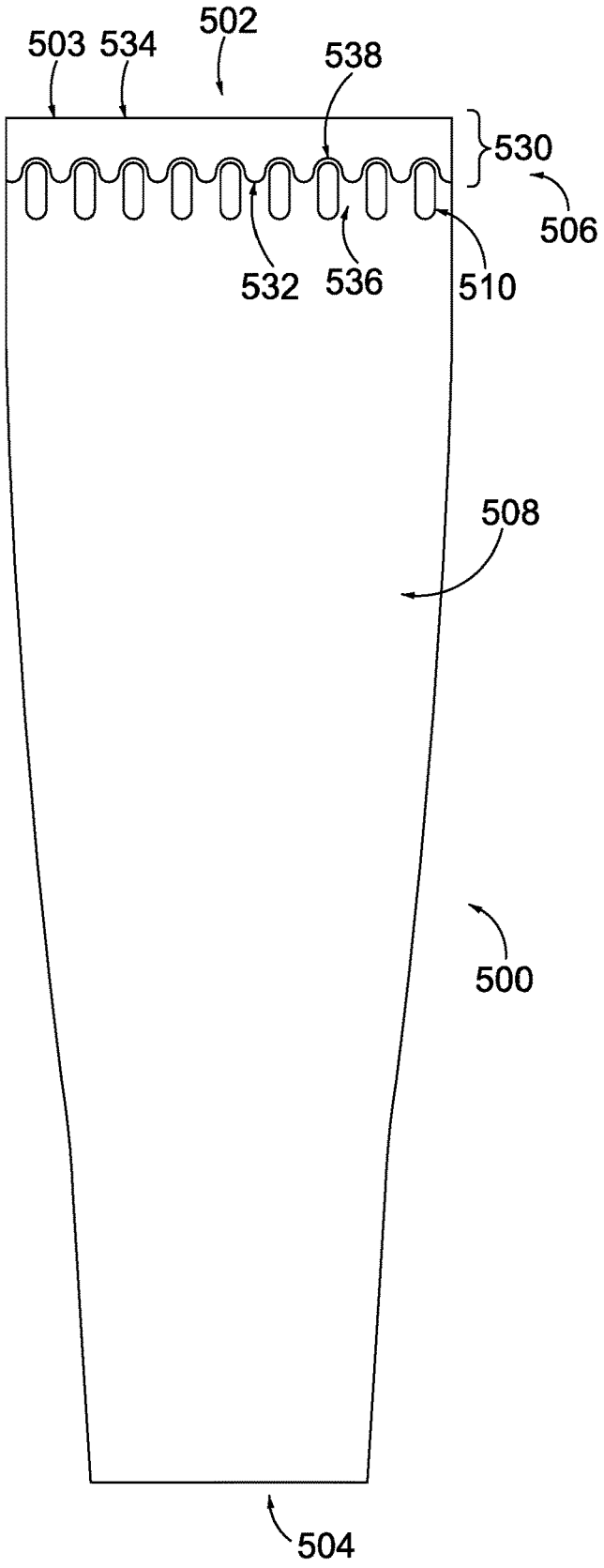
FIG. 5 illustrates an inside-out view of an extremity covering portion in the form of a compression sleeve having a grip film in accordance with aspects herein.

Turning to FIG. 5, a plan view of an extremity covering portion 500 is illustrated in accordance with aspects herein. As used herein, an extremity may refer to a limb of the body, such as an arm or a leg. The extremity covering portion 500 is shown in the form of an inside-out, upper-body extremity covering portion to better illustrate the described features. Although shown as a stand-alone upper-body extremity covering portion, such as a compression sleeve, the extremity covering portion 500 may also comprise a stand-alone lower body extremity covering portion (e.g., a calf sleeve) or may be the extremity covering portion of an upper-body garment. The extremity covering portion 500 may comprise a grip film 506 on at least a portion of at least one opening of the extremity covering portion 500. The grip film 506 may have any one or more features of the grip film 100, the grip film 200, the grip film 300, and/or the grip film 400. The grip film 506 may comprise an edge trim portion 530 and a plurality of ovoid portions 510. The edge trim portion 530 has a first edge 534 and a second edge 532 opposite the first edge 534. The plurality of ovoid portions 510 are configured such that at least one end of each ovoid portion 510 is at least partially disposed in a trough 538 formed by the second edge 532 having a wave-shaped configuration.

The extremity covering portion 500 comprises a first opening 502 and a second opening 504, opposite the first opening 502. In aspects, the first opening 502 is at the proximal end of the extremity covering portion 500 when the extremity covering portion 500 is in an as-worn configuration and may have a larger sized opening than the second opening 504. The first opening 502 is defined by an edge 503. The grip film 506 may be coupled or affixed to an inner-facing surface 508 at or near the proximal end of the extremity covering portion 500 such that the first edge 534 of the edge trim portion 530 is congruent with (or aligned with) the edge 503 of the first opening 502 of the extremity covering portion 500. It is also contemplated herein that the first edge 534 of the edge trim portion 530 may be spaced apart from the edge 503 of the first opening 502 by a small amount. For instance, the first edge 534 may be spaced apart from the edge 503 by up to about 1 cm.

The grip film 506 may extend continuously around one or more portions of the edge 503 or may extend continuously and circumferentially around the entire circumference of the edge 503. In other aspects, the grip film 506 may additionally or alternatively be coupled to the distal end of the extremity covering portion 500, bordering and congruent with an edge defined by the second opening 504. In aspects, the grip film 506 may configured to be on the inner-facing surface 508 of the extremity covering portion 500 such that the grip film 506 is positioned adjacent to or in contact with a skin surface of a wearer when the extremity covering portion 500 is in an as-worn configuration. In other aspects, the grip film 506 may be configured to be on an outer-facing surface (not shown) of the extremity covering portion 500 or on both the inner-facing surface 508 and the outer-facing surface of the extremity covering portion 500 when the extremity covering portion 500 is in an as-worn configuration. Any and all aspects, and any variation thereof, are contemplated as being within aspects herein.

As mentioned, the edge trim portion 530 may extend continuously around a respective opening except for, for instance, where two ends of the edge trim portion 530 may meet at a seam line. It is also contemplated herein that the ovoid portions 510, although they comprise separate and discrete elements may extend circumferentially around the respective opening.

The extremity covering portion 500 may also comprise a portion of a garment. In aspects, the extremity covering portion 500 may comprise a sleeve of an upper-body garment or an upper-body portion of a garment (e.g., a short sleeve or a long sleeve). The extremity covering portion 500 may be attached to or extend from a sleeve opening on a torso portion of the garment at the proximal end of the extremity covering portion 500 and have an opening (e.g., second opening 504) at the distal end. In this aspect, the grip film 506 may be coupled to an inner-facing surface of an edge defined by an opening at the distal end of the extremity covering portion 500, through which the arm or leg of a wearer may extend when the garment is in an as-worn configuration. In other aspects, the grip film 506 may be configured to be on an outer-facing surface of the distal end of the extremity covering portion 500, or on both the inner-facing and the outer-facing surface of the distal end of the extremity covering portion 500 when the garment is in an as-worn configuration.

Figure 6A:
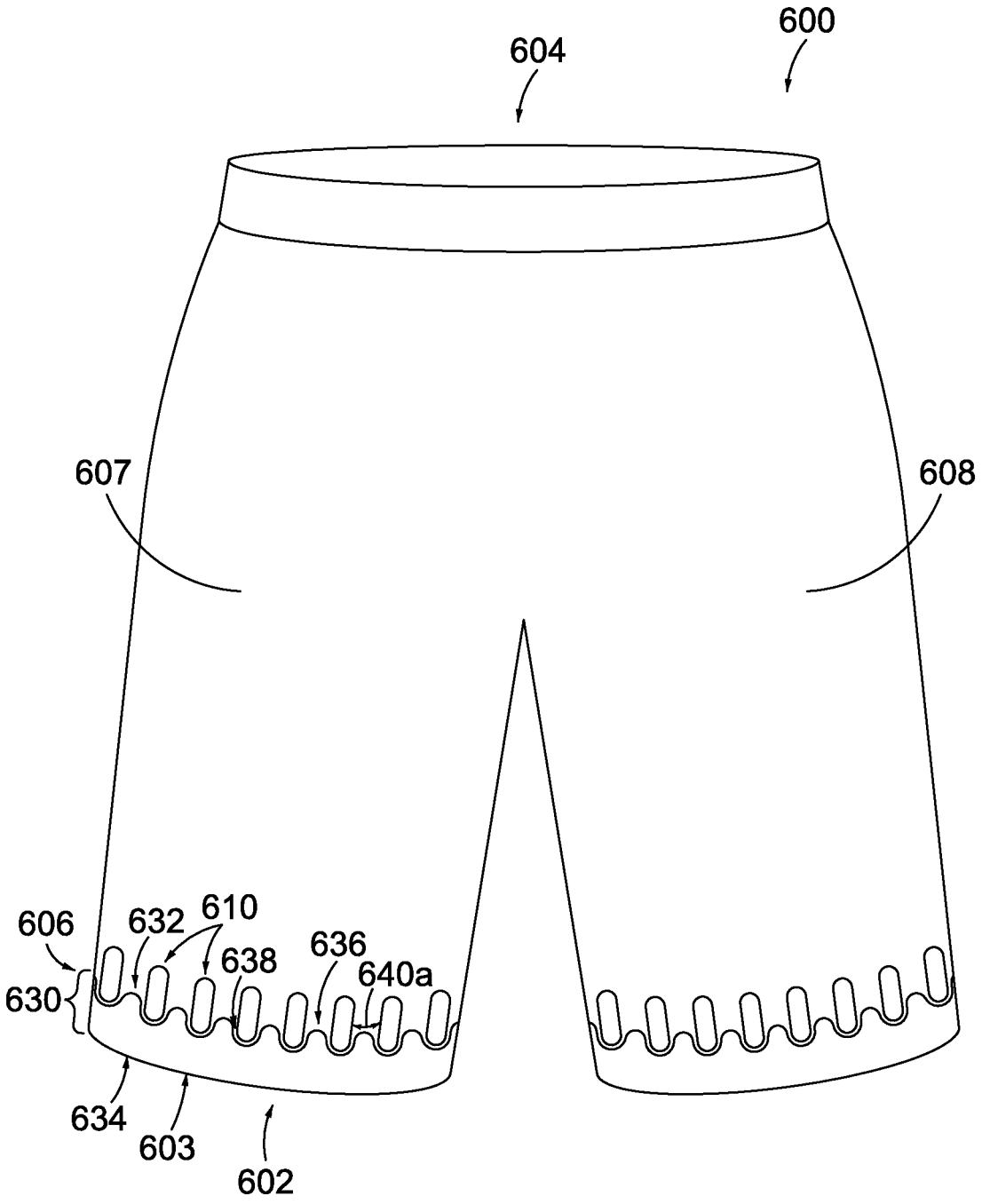
FIG. 6A illustrates an inside-out view of a garment in an un-donned state, the garment comprising an extremity covering portion for the legs of a wearer having a grip film in accordance with aspects herein.

An extremity covering portion of a lower-body garment 600 is shown in FIG. 6A in accordance with aspects herein, where the lower-body garment 600 is shown doffed and inside-out to better illustrate the described features. The extremity covering portion is in the form of a first leg portion 607 and a second leg portion 608 of the lower-body garment 600. Although shown as a short, it is contemplated that the lower-body garment 600 may be in the form of a unitard, singlet, or other one-piece garment. Further, in aspects, it is contemplated herein that the lower-body garment 600 may comprise a compression garment. In aspects, the lower-body garment 600 may comprise a waist opening 604 and second openings 602 at the distal end of the first and second leg portions 607 and 608.

The lower-body garment 600 may comprise a grip film 606, the grip film 606 having any one or more features of the grip film 100, the grip film 200, the grip film 300, the grip film 400, and/or the grip film 506. The grip film 606 is shown, in detail, as being positioned on the first leg portion 607 for illustrative purposes, but it is contemplated herein that the grip film 606 may be positioned on both the first and second leg portions 607 and 608. In aspects, the grip film 606 may be configured to be on an inner-facing surface of the first and second leg portions 607 and 608 when the lower-body garment 600 is in an as-worn configuration. In other aspects, the grip film 606 may be configured to be on an outer-facing surface or on both the inner-facing and the outer-facing surface of the first and second leg portions 607 and 608. It is also contemplated herein that an additional grip film may be located at the waist opening 604 to help prevent the edge of the waist opening from rolling during wear.

The grip film 606 comprises an edge trim portion 630 and at least one ovoid portion 610. The edge trim portion 630 has a first edge 634 and a second edge 632 opposite the first edge 634. In aspects, the first edge 634 is substantially linear (+/−5 degrees); in other aspects, the first edge 634 may be curved. In any configuration, the first edge 634 may be congruent with (or aligned with) an edge 603 defined by the second opening 602 of the first leg portion 607. Or it may be spaced apart from the edge 603 by a small space. The second edge 632 may have a wave-shaped configuration, forming at least one trough 638 and at least one peak 636. At least one end of the ovoid portion(s) 610 is at least partially disposed in the trough 638 such that a gap exists between the second edge 632 and the ovoid portion 610. A space 640*a* separates adjacent ovoid portions 610 while the lower-body garment 600 is in a doffed state; that is, when the grip film 606 is in an unstretched state.

Figure 6B:
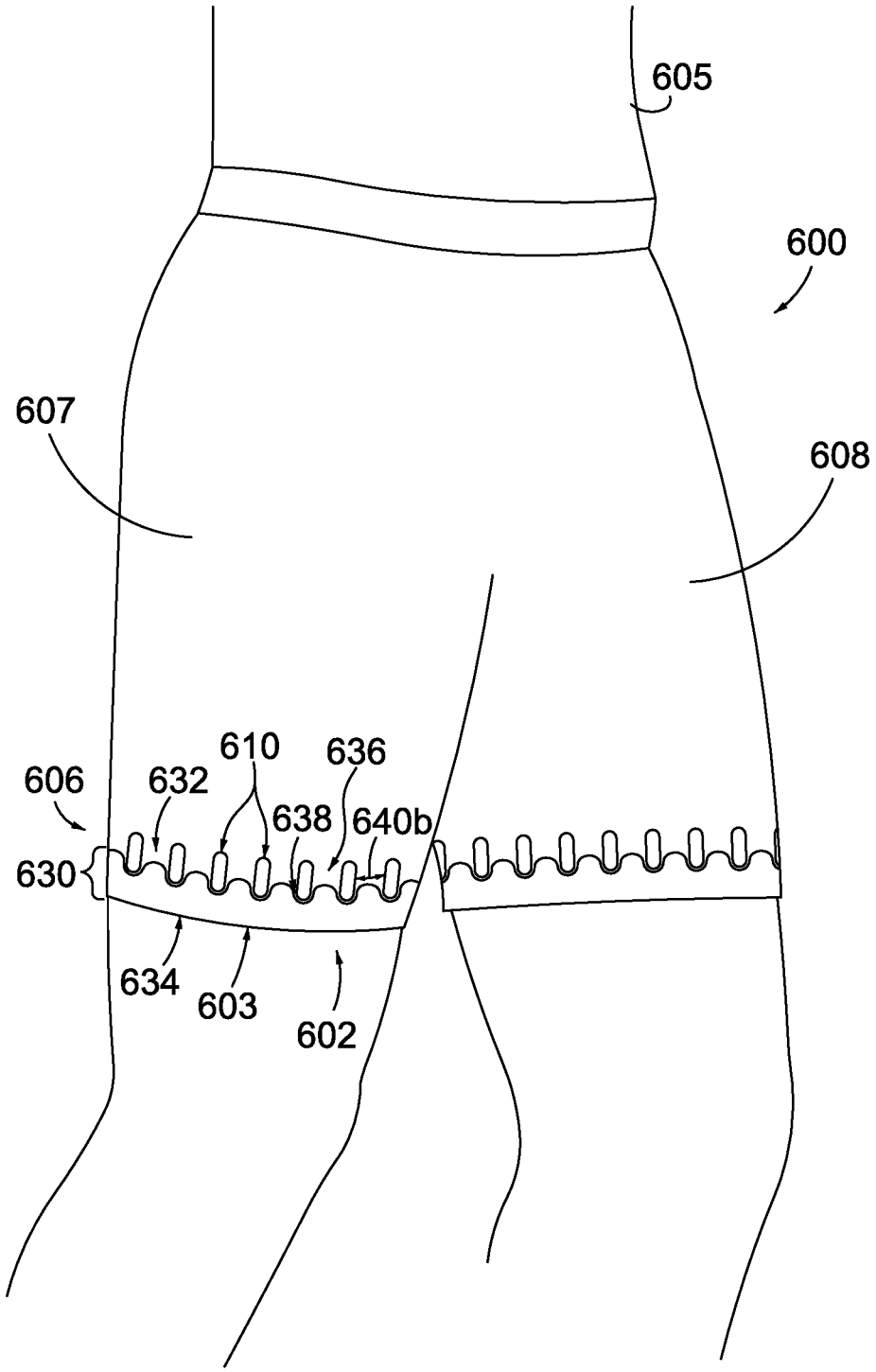
FIG. 6B illustrates the garment of FIG. 6A in a donned state in accordance with aspects herein.

The extremity covering portion of the lower-body garment 600 of FIG. 6A is shown in FIG. 6B in accordance with aspects herein, where the lower-body garment 600 is shown donned by a wearer 605 and inside-out to further illustrate the described features. As seen in FIG. 6B, when donned, the lower-body garment 600, and the grip film 606 positioned thereon may stretch to conform to the legs of the wearer 605. In aspects, any one or more portions of the grip film 606 may stretch parallel to the edge 603, with resultant elongation of at least one of the peak(s) 636, trough(s) 638, and/or widening of at least one ovoid portion(s) 610. Elongation of the at least one peak 636, for example, may also increase the inter-ovoid distance 640*b* to become greater than the distance 640*a*. In other aspects, the at least one trough 638 may stretch more than the at least one peak 636 along an axis parallel to the edge 603. In some aspects, one or more of the ovoid portions 610 may further widen along an axis parallel to the edge 603 proximate to the end of the ovoid portion 610 at least partially disposed in the trough 638.

As seen in FIG. 6B, the grip film 606 gradually increases in surface area when moving from a proximal to a distal aspect of the first leg portion 607. For instance, by using separate and distinct ovoid portions 610, the surface area occupied by the ovoid portions 610 may be less than that occupied by the continuous edge trim portion 630. And by having the second edge 632 of the edge trim portion 630 be wave shaped as opposed to linear, the surface area occupied by grip film 606 adjacent to the second edge 632 of the edge trim portion 630 may be less than the surface area occupied by the grip film 606 adjacent to the first edge 634 of the edge trim portion 630. The result is a gradual increase in surface area, and a corresponding gradual increase in compression, when moving from the ovoid portions 610 to the first edge 634 of the edge trim portion 630.

An accessory, such as a glove, hat, sock, or other article that may benefit from one or more openings having gripping properties may comprise any one or more of the features described in relation to any aspect herein. For example, a compression sock having an opening proximate to a foot portion may desirably have gripping properties to prevent or reduce the likelihood that the sock will slip or roll down the leg of a wearer. In aspects, the compression sock may comprise a grip film in accordance with aspects herein, wherein the grip film is disposed on the inner-facing surface of the article when it is in an as-worn configuration.

Figure 7:
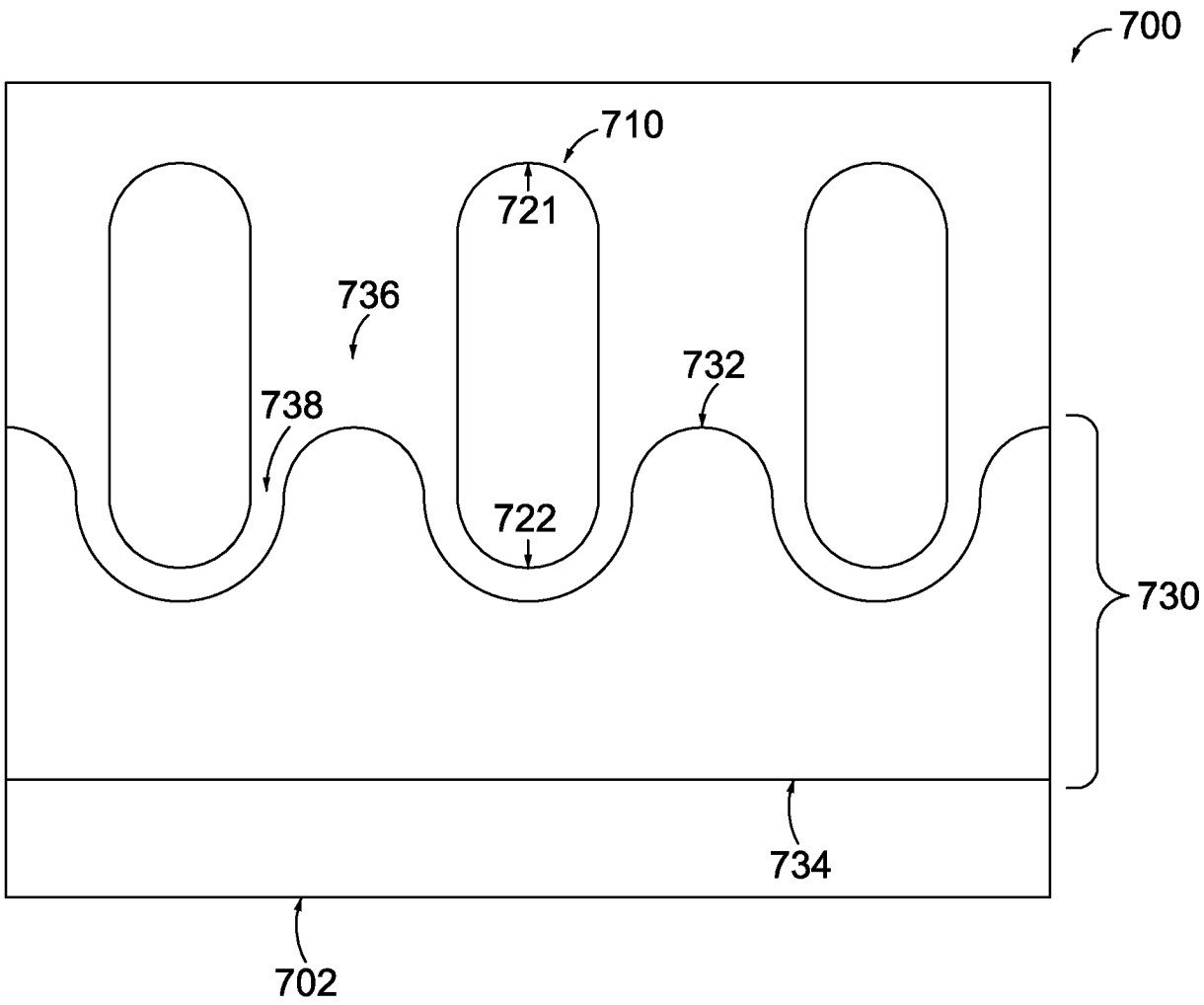
FIG. 7 illustrates a plan view of a grip film kit in accordance with aspects herein.

FIG. 7 shows a plan view of an example grip film kit 700, in accordance with aspects hereof. In aspects, a grip film comprising an edge trim portion 730 and at least one ovoid portion 710 may be temporarily bonded to a carrier sheet 702 to form the grip film kit 700. The grip film may have any one or more features of any one or more aspects of the grip films disclosed above. The grip film kit 700 may be configured such that when applied to a substrate, such as a garment or a textile, the grip film is bonded to the substrate, using for example, a heat activated adhesive, and the carrier sheet is removed.

In aspects, the grip film kit 700 may be affixed to the substrate by bonding the grip film portion directly to the substrate and removing the carrier sheet 702. The grip film kit 700 may be thus configured with the grip film being temporarily bonded to the carrier sheet 702. The temporary bond may be made with an adhesive or other interaction between the materials effective to maintain the materials, temporarily, in a set relative position (e.g., electrostatic adhesion). The grip film may then be applied to the substrate using an adhesive or bonding process, such as a heat press, to create a more permanent bond between the grip film and the substrate. Being that the bond between the grip film and the substrate is stronger than the bond between the grip film and the carrier sheet 702, the carrier sheet 702 can be removed from the grip film without altering the bond between the grip film and the substrate.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A film configured to provide grip to an edge of a garment, the film comprising:

an edge trim portion having a first edge and a second edge opposite the first edge, the second edge comprising at least one peak and at least one trough; and at least one ovoid portion having a first end and a second end opposite the first end along a major axis of the at least one ovoid portion, wherein the first end of the at least one ovoid portion is at least partially disposed within the at least one trough.

2. The film of claim 1, wherein the second edge of the edge trim portion comprises a sinusoidal wave form.

3. The film of claim 1, wherein the at least one ovoid portion comprises an ellipsoid shape.

4. The film of claim 1, wherein the film comprises an elastomer.

5. The film of claim 4, wherein the elastomer comprises polyurethane.

6. The film of claim 1, wherein the first edge is linear.

7. The film of claim 1, wherein the first edge is curved.

8. The film of claim 1, wherein the at least one ovoid portion extends perpendicularly away from the first edge.

9. An extremity covering comprising:

a film comprising:

an edge trim portion that extends circumferentially around an edge of a first opening of the extremity covering, the edge trim portion having a first edge and a second edge opposite the first edge, the first edge aligned with the edge of the first opening of the extremity covering, the second edge having a plurality of peaks and a plurality of troughs; and a plurality of ovoid portions, each ovoid portion having a first end and a second end opposite the first end along a major axis of the each ovoid portion, wherein the first end of the each ovoid portion is at least partially disposed within a trough of the plurality of troughs of the edge trim portion.

10. The extremity covering of claim 9, wherein the extremity covering is a portion of a garment.

11. The extremity covering of claim 9, wherein the extremity covering comprises a leg portion of a lower-body garment.

12. The extremity covering of claim 9, wherein the extremity covering comprises an arm portion of an upper-body garment.

13. The extremity covering of claim 9, wherein the extremity covering comprises a compression sleeve.

14. The extremity covering of claim 13, wherein the film is disposed on an inner-facing surface of a proximal end of the compression sleeve.

15. The extremity covering of claim 9, wherein the film is disposed on an inner-facing surface of the extremity covering.

16. The extremity covering of claim 9, wherein the film comprises an elastomer.

17. The extremity covering of claim 16, wherein the elastomer comprises polyurethane.

18. A kit for applying a grip film, the kit comprising:

a carrier sheet;

an edge trim portion having a first edge and a second edge opposite the first edge, the second edge having a wave-shaped configuration having at least one peak and at least one trough, the edge trim portion overlaid and temporarily adhered to the carrier sheet; and at least one ovoid portion, the at least one ovoid portion having a first end and a second end opposite the first end along a major axis of the at least one ovoid portion, wherein the first end of the at least one ovoid portion is at least partially disposed within the at least one trough, the at least one ovoid portion overlaid and temporarily adhered to the carrier sheet.

19. The kit for applying the grip film of claim 18, wherein a space of less than about 5 mm separates the first end of the at least one ovoid portion on the major axis of the at least one ovoid portion from the second edge of the at least one trough.

20. The kit for applying the grip film of claim 18, wherein the edge trim portion comprises a continuous construction.

* * * * *